US007424121B2

(12) United States Patent
Kubota

(10) Patent No.: US 7,424,121 B2
(45) Date of Patent: Sep. 9, 2008

(54) AUDIO SIGNAL PROCESSING METHOD AND AUDIO SIGNAL PROCESSING APPARATUS

(75) Inventor: Kazunobu Kubota, Saitama (JP)

(73) Assignee: Sony Corporation, Tokyo (JP)

( * ) Notice: Subject to any disclaimer, the term of this patent is extended or adjusted under 35 U.S.C. 154(b) by 1217 days.

(21) Appl. No.: 09/918,007

(22) Filed: Jul. 30, 2001

(65) Prior Publication Data

US 2002/0021811 A1 Feb. 21, 2002

(30) Foreign Application Priority Data

Aug. 1, 2000 (JP) ..... P2000-233337

(51) Int. Cl.
*H04R 5/02* (2006.01)
*H04R 5/00* (2006.01)
*A63F 9/24* (2006.01)

(52) U.S. Cl. ..... 381/310; 381/17; 381/18; 381/307; 463/35; 463/30; 463/1

(58) Field of Classification Search ..... 381/310, 381/17, 18, 307; 463/35, 1, 30, 6, 40
See application file for complete search history.

(56) References Cited

U.S. PATENT DOCUMENTS 4,296,476 A * 10/1981 Mayer et al. ..... 345/553
4,695,874 A * 9/1987 Sasson ..... 348/489
5,583,791 A * 12/1996 Harigaya et al. ..... 348/575
5,768,393 A 6/1998 Mukojima et al.
5,796,843 A * 8/1998 Inanaga et al. ..... 381/17
5,850,455 A 12/1998 Arnold et al.

FOREIGN PATENT DOCUMENTS

EP 0 616 312 9/1994
EP 0 813 351 A2 12/1997

OTHER PUBLICATIONS

Applicant's admitted prior art, Figure 4 , pp. 1-4, Description of Related Art.*
Applicant's admitted prior art, Figures 4 and 7, pp. 1-4, Description of Related Art.*
Sandvad, J."Dynamic Aspects of Auditory Virtual Environments" Preprints of Papers Presented at the AES Convention, vol. 100th conference, No. Preprint 4226, May 11, 1996, pp. 1-15.

* cited by examiner

*Primary Examiner*—Vivian Chin
*Assistant Examiner*—Devona E Faulk
(74) *Attorney, Agent, or Firm*—Lerner, David, Littenberg, Krumholz & Mentlik, LLP

(57) ABSTRACT

An audio signal processing method that performs virtual acoustic image localization processing for sound source signals having at least one type of information among position information, movement information, and localization information based on this information there are a plurality of changes in this information within a prescribed time unit, a single information change is generated based on this plurality of information changes, and virtual acoustic image localization processing is performed for the sound source signals based on this generated information change.

12 Claims, 5 Drawing Sheets

AUDIO SIGNAL PROCESSING METHOD AND AUDIO SIGNAL PROCESSING APPARATUS

BACKGROUND OF THE INVENTION

1. Field of the Invention

This invention relates to an audio signal processing method and audio signal processing apparatus to perform virtual acoustic image localization processing of a sound source, appropriate for application in, for example, game equipment, personal computers and the like.

2. Description of the Related Art

There widely exists game equipment which performs virtual acoustic image localization processing. In this game equipment and similar (refer to FIG. 4) there is a central processing unit (CPU) 1, consisting of a microprocessor which controls the operations of the overall equipment. Sound source position information, movement information, and other information necessary for virtual acoustic image localization processing by an audio processing unit 2 is transmitted from this CPU 1 to the audio processing unit 2.

In this audio processing unit 2, as shown in FIG. 5, the position and movement information received from the CPU (position information and movement information for virtual acoustic image localization) is used to perform virtual acoustic image localization processing for incoming monaural audio signals. Of course, input signals are not limited to monaural audio signals, and a plurality of sound source signals can be accommodated by performing filter processing according to their respective localization positions and finally adding the results.

As is widely known, by performing appropriate filter processing of monaural audio signals based on the transfer functions from the position at which the acoustic image is to be localized to both the listener's ears (HRTF: Head Related Transfer Function) and the transfer functions from a pair of speakers placed in front of the listener to both the listener's ears, the acoustic image can also be localized in places other than the positions of the pair of speakers, for example, behind or to one side of the listener. In the specification for this patent, this is called virtual acoustic image localization processing. The reproducing device may be speakers, or may be headphones or earphones worn by the listener. The details of the signal processing differ somewhat depending on the device, but in any case the output obtained is a pair of audio signals (stereo audio signals). By reproducing these stereo audio signals using an appropriate pair of transducers (speakers or headphones) SL, SR as shown in FIG. 6, an acoustic image can be localized at an arbitrary position.

As incoming monaural audio signals, for example, signals which are accumulated in memory 3 and which are read out from memory 3 as appropriate, signals which are generated within the CPU 1 or by a sound generation circuit, not shown, and synthesized effect sounds and noise are conceivable. These signals are supplied to the audio processing unit 2 in order to perform virtual acoustic image localization processing.

By associating position information and movement information for the sound source with sound source audio signals, a sound source object can be configured. When there are a plurality of sound source objects for virtual acoustic image localization, the audio processing unit 2 receives from the CPU 1 the position and movement information for each, and the plurality of these incoming monaural audio signals is subjected to the corresponding respective virtual acoustic image localization processing; as shown in FIG. 5, the plurality of stereo audio signals thus obtained are added (mixed) for each of the right and left channels, for output as a pair of stereo audio signals, and in this way virtual acoustic image localization processing is performed for a plurality of sound source objects.

This localization processing of a plurality of virtual acoustic images is performed within the audio processing unit 2. Originally, in this localization processing of a plurality of virtual acoustic images, each time there is a change in the position or movement information computed within the CPU 1 as shown in FIG. 7, this position and movement information is transmitted to the audio processing unit 2, and in this audio processing unit 2 this position and movement information is used to perform virtual acoustic image localization processing, while changing the internal filter coefficients and other parameters each time there is a change.

However, as shown in FIG. 7, when the above processing is performed in the audio processing unit 2 each time there is a change in the position or movement information, when there are frequent changes or updates in the position or movement information, in addition to the usual virtual acoustic image localization processing, changes in internal processing coefficients must also be made within the audio processing unit 2, with the undesired consequence that the signal processing volume becomes enormous.

SUMMARY OF THE INVENTION

Hence one object of this invention is to provide an audio signal processing method comprising the following: An audio signal processing method of this invention is an audio signal processing method which performs virtual acoustic image localization processing for sound source signals having at least one information type among position information, movement information and localization information, based on this information, and which, when there are a plurality of changes in this information within a prescribed time unit, generates a single information change based on this plurality of information changes, and based on this generated information change performs virtual acoustic image localization processing of the sound source signals.

Another object of this invention is to provide an audio signal processing method comprising the following: An audio signal processing method of this invention performs virtual acoustic image localization processing in advance for sound source signals based on a plurality of localization positions of the sound source signals; stores in storage means the plurality of synthesized sound source signals obtained through this localization processing; when a plurality of changes in at least one information type among the position information, movement information or localization information for the sound source signals occur within a prescribed time unit, generates one information change based on this plurality of information changes; and, based on this generated information change, reads and reproduces the synthesized sound source signals from the storage means.

Still another object of this invention is to provide an audio signal processing apparatus comprising the following:

An audio signal processing apparatus of this invention is an audio signal processing apparatus having an audio processing unit which localizes virtual acoustic images for sound source signals having at least one information type among position information, movement information and localization information, based on this information; is provided with information change generation means which generates one information change based on a plurality of information changes when there are a plurality of information changes within a prescribed time unit; and controls the audio processing unit, based on the information change obtained from this information change generation means, to modify the virtual acoustic image localization position.

Still another object of this invention is to provide an audio signal processing apparatus comprising the following:

Also, an audio signal processing apparatus of this invention is provided with storage means to store a plurality of synthesized sound source signals, obtain by performing virtual acoustic image localization processing in advance of sound source signals based on a plurality of localization positions for these sound source signals, and with information change generation means to generate one information change when a plurality of changes occur in at least one type of information among position information, movement information, and localization information for the sound source signals within a prescribed time unit, based on this plurality of information changes; and reads out and reproduces, from this storage means, synthesized sound source signals according to information changes obtained from this information change generation means.

By means of this invention, modifications of internal processing coefficients accompanying changes in a plurality of information elements, and readout of synthesized sound source signals, are performed a maximum of one time each during each prescribed time unit, so that processing can be simplified, efficiency can be increased, and the volume of signal processing can be reduced.

DESCRIPTION OF THE PREFERRED EMBODIMENTS

Figure 1:
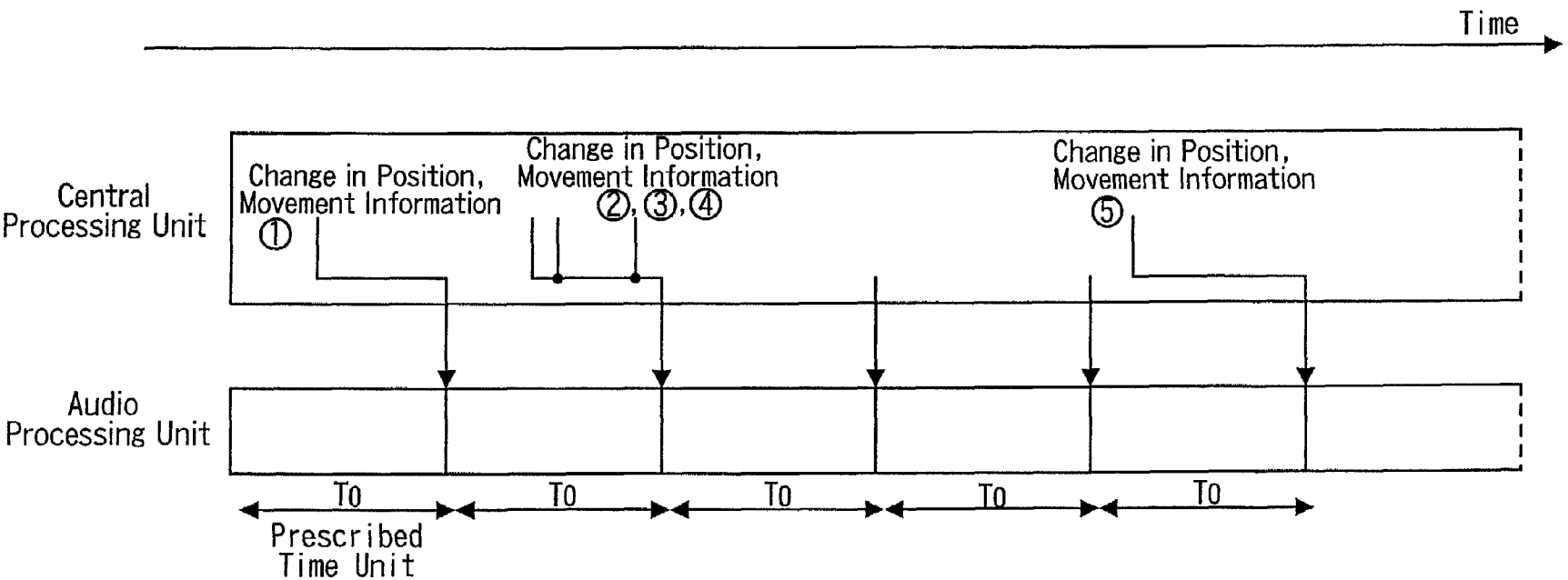
FIG. 1 is a line diagram used in explanation of an example of an embodiment of an audio signal processing method of this invention.

Below, preferred embodiments of the audio signal processing method and audio signal processing apparatus of the invention are explained, referring to the drawings.

Figure 4:
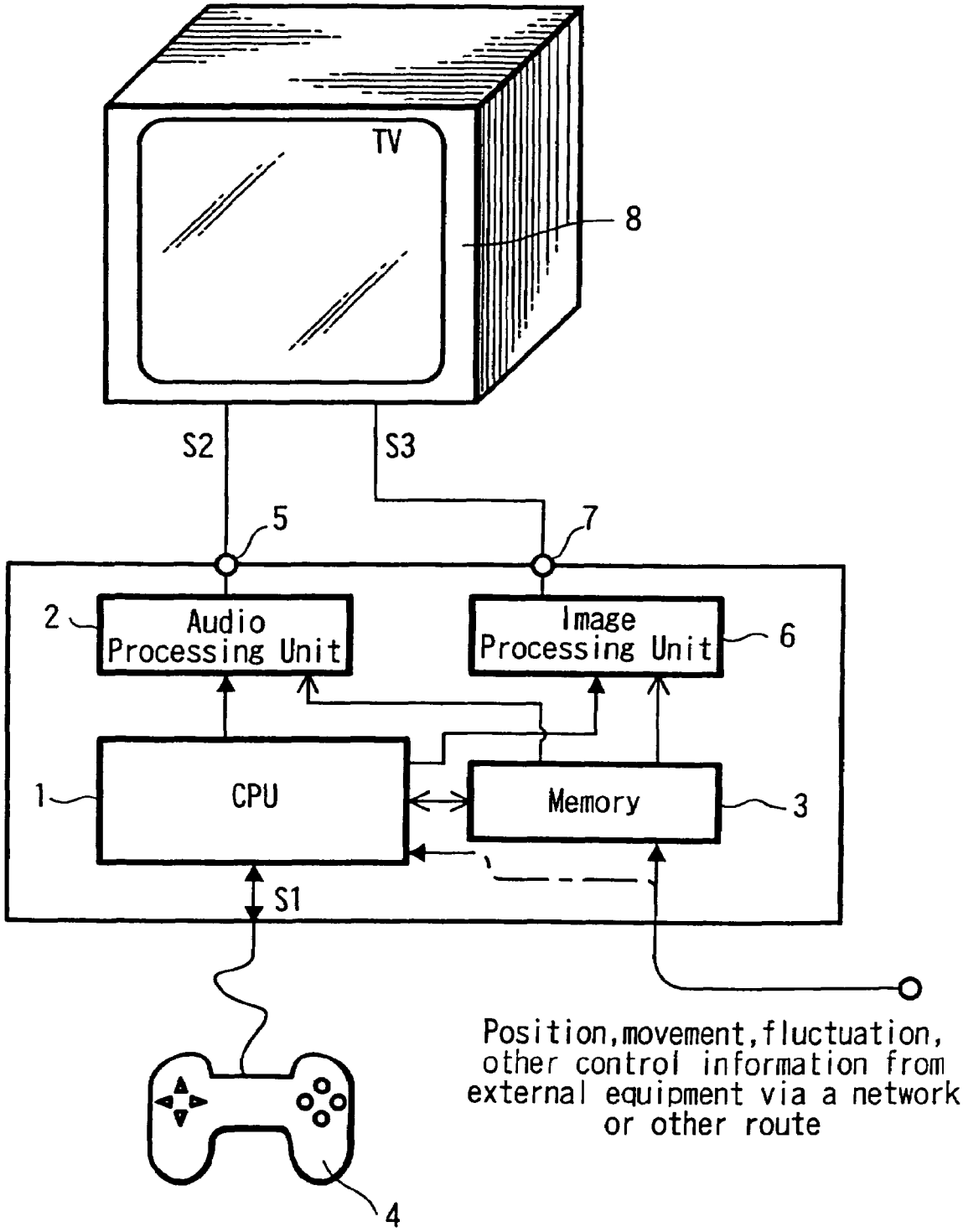
FIG. 4 (PRIOR ART)
FIG. 4 is a diagram of the configuration of an example of game equipment.

First, as an example, game equipment to which this invention is applied is explained, referring to FIG. 4.

The game equipment has a central processing unit (CPU) 1 consisting of a microcomputer which controls the operations of the equipment as a whole; when an operator operates an external control device (controller) 4, external control signals S1 are input to this CPU 1 according to the operation of the controller 4.

The CPU 1 reads from the memory 3 sound source signals and information to determine the position and movement of the sound source arranged as a sound source object. The position information which this sound source object provides refers to position coordinates in a coordinate space assumed by a game program or similar, and the coordinates may be in an orthogonal coordinate system or in a polar coordinate system (direction and distance). Movement information is represented as a vector quantity indicating the speed of motion from the current coordinates to the subsequent coordinates; localization information may be relative coordinates as seen by the game player (listener). To this memory 3, consisting for example of ROM, RAM, CD-ROM, DVD-ROM or similar, is written the necessary information, such as a game program, in addition to the sound source object. The memory 3 may be configured to be installed in (loaded into) the game equipment.

The sound source position and movement information (also including localization information) computed within the CPU 1 is transmitted to the audio processing unit 2, and based on this information, virtual acoustic image localization processing is performed within the audio processing unit 2.

When there are a plurality of sound source objects to be reproduced, the position and movement information of the each of sound source objects is received from the CPU 1, and virtual acoustic image localization processing is performed within this audio processing unit 2, by parallel or time-division methods.

Figure 5:
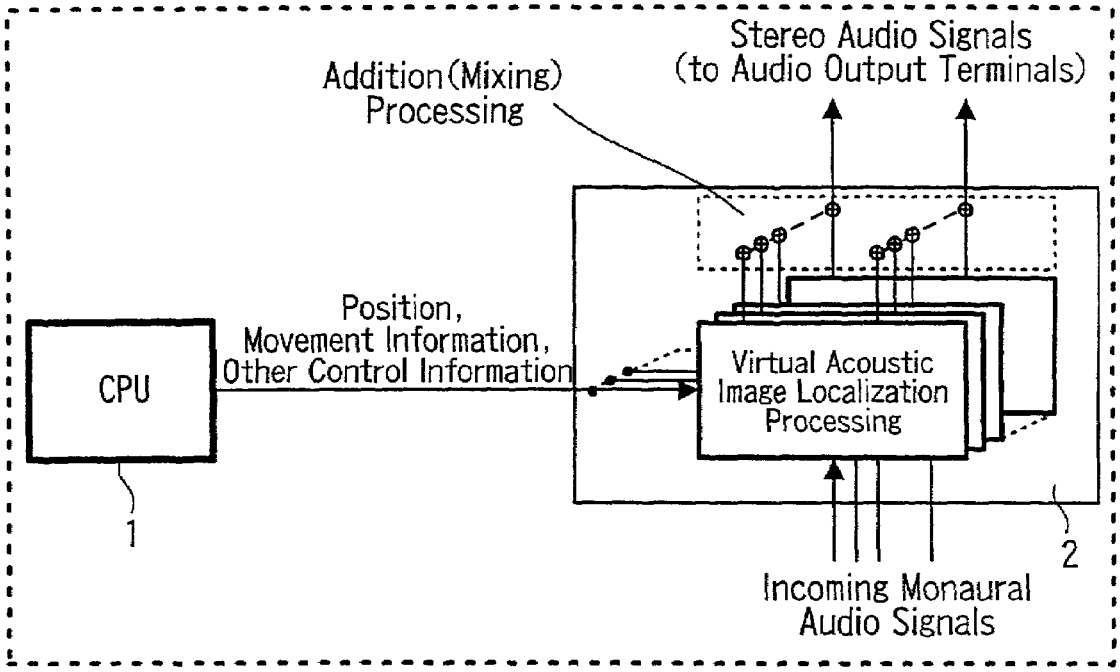
FIG. 5 is a line diagram used in explanation of FIG. 4.
Figure 6:
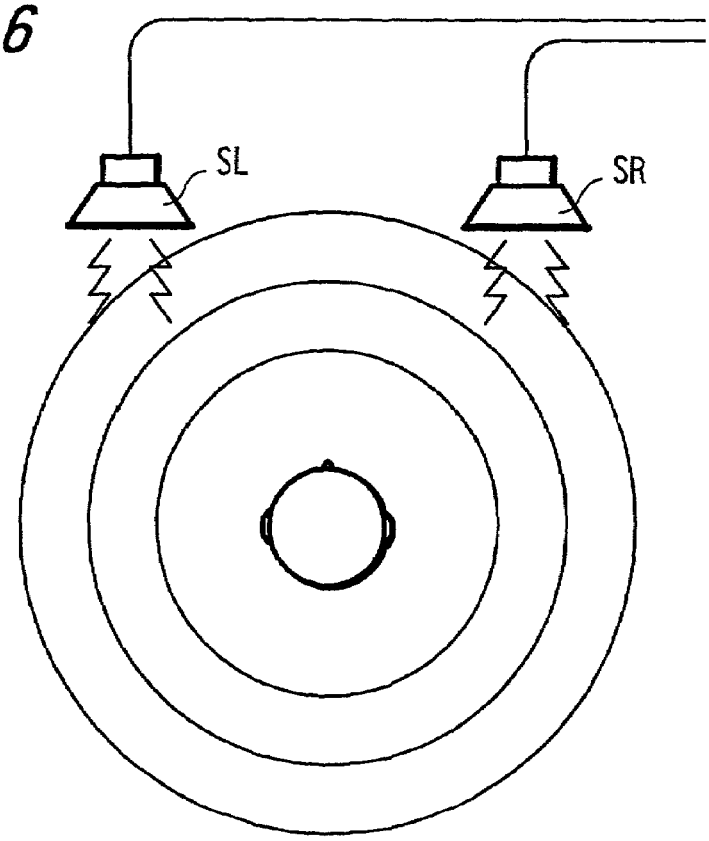
FIG. 6 is a line diagram used in explanation of virtual acoustic image localization.
Figure 7:
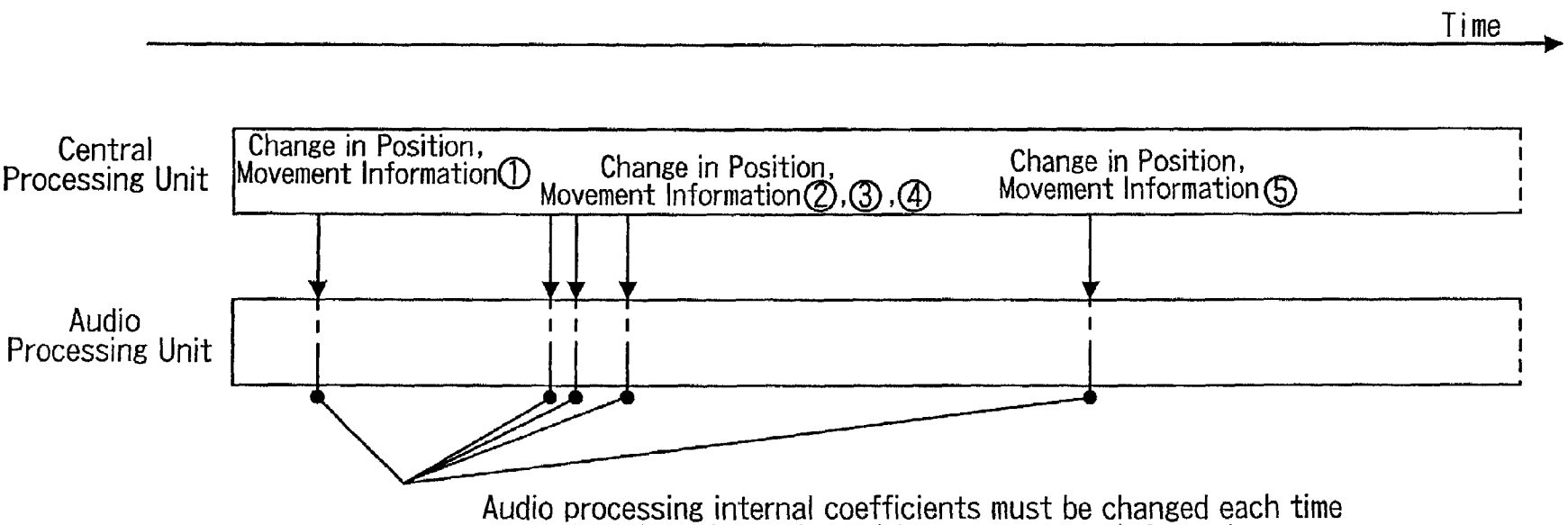
FIG. 7 is a line diagram used in explanation of an example of an audio signal processing method of the prior art.

As shown in FIG. 5, stereo audio signals obtained by virtual acoustic image localization processing and output, and other audio signals, are then mixed, and are supplied as stereo audio output signals to, for example, the two speakers of the monitor 8 via the audio output terminals 5.

Cases are also conceivable in which the operator performs no operations and in which the controller 4 does not exist. There are also cases in which position information and movement information for the sound source object are associated with time information and event information (trigger signals for action); these are recorded in memory 3, and sound source movements determined in advance are represented. There are also cases in which information on random movement is recorded, in order to represent fluctuations. Such fluctuations may be used, for example, to add explosions, collisions, or more subtle effects.

In order to represent random movements, software or hardware to generate random numbers may be installed within the CPU 1; or, a random number table or similar may be stored in memory 3. In the embodiment of FIG. 4, an external control device (controller) 4 is operated by an operator to supply external control signals S1; however, headphones are known which detect movements (rotation, linear motion, and so on) of the head of the operator (listener), for example, by means of a sensor, and which modify the acoustic image localization position according to these movements. The detection signals from such a sensor may be supplied as these external control signals.

To summarize, there are cases in which the sound source signals in the memory 3 are provided in advance with position information, movement information and similar, and cases in which they are not so provided. In either case, position change information supplied according to instructions, either internal or external, are added, and the CPU 1 determines the acoustic image localization position of these sound source signals. For example, in a case in which movement information in a game, such as that of an airplane which approaches from the forward direction, flies overhead, and recedes in the rearward direction, is stored in memory 3 together with sound source signals, if the operator operates the controller 4 to supply an instruction to turn in the left direction, the acoustic image localization position will be modified such that the sound of the airplane recedes in the right relative direction.

This memory 3 may not necessarily be within the same equipment; for example, information can be received from different equipment over a network, or a separate operator may exist for separate equipment. There may be cases in which positioning is performed for sound source objects, including the operation information and fluctuation information generated from the separate equipment.

On the basis of the position and movement information determined by the CPU 1, employing position change information supplied according to internal or external instructions in addition to the position and movement information provided by the sound source signals in advance, the audio processing unit 2 performs virtual acoustic image localization processing of monaural audio data read out from this memory 3, and outputs the result as stereo audio output signals S2 from the audio output terminals 5.

Simultaneously, the CPU 1 sends data necessary for image processing to an image processing unit 6, and this image processing unit 6 generates image signals and supplies the image signals S3 to a monitor 8 via an image output terminal 7.

In this example, even when there are a plurality of changes or updates in the position and movement information of the sound source object to be reproduced within the prescribed time unit $T_0$, the CPU 1 forms a single information change within this prescribed time unit $T_0$, and sends this to the audio processing unit 2. At the audio processing unit 2, virtual acoustic image localization processing is performed once, based on the single information change within the prescribed time unit $T_0$.

It is desirable that this prescribed time unit $T_0$ be chosen as a time appropriate for audio processing.

This time unit $T_0$ may for example be an integral multiple of the sampling period when the sound source signals are digitized. In this example, the clock frequency of digital audio signals is 48 kHz, and if the prescribed time unit $T_0$ is ,for example, 1024 times the sampling period, then it is 21.3 mS.

In virtual acoustic image localization processing within this audio processing unit 2, this time unit $T_0$ is not synchronized in a strict sense with the image signal processing; by setting this time unit $T_0$ to an appropriate length so as not to detract from the feeling of realism during audio playback, taking into account the audio processing configuration of the game equipment, the audio processing unit 2, and other equipment configurations, the amount of processing can be decreased.

Figure 2:
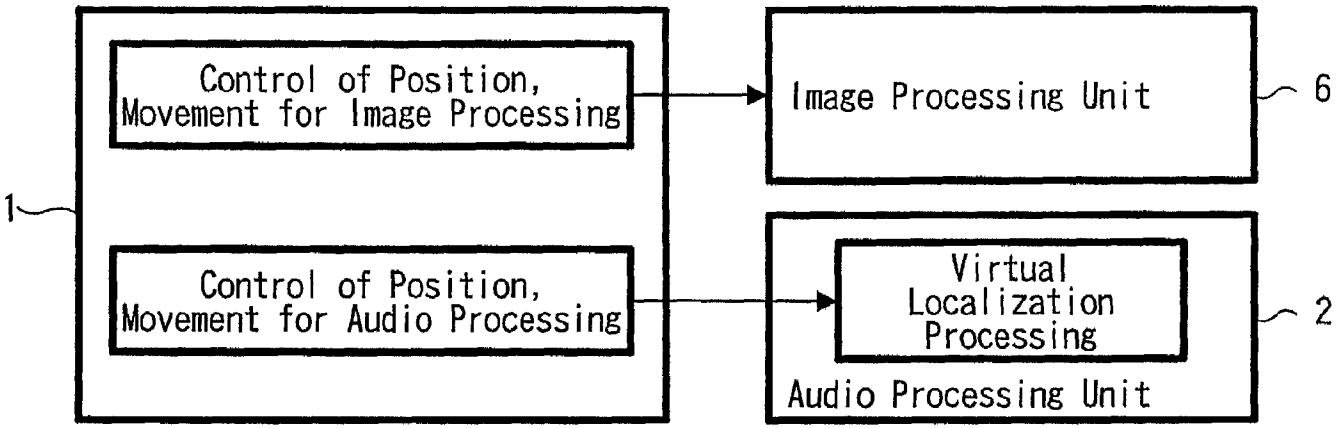
FIG. 2 is a line diagram used in explanation of this invention.
Figure 3:
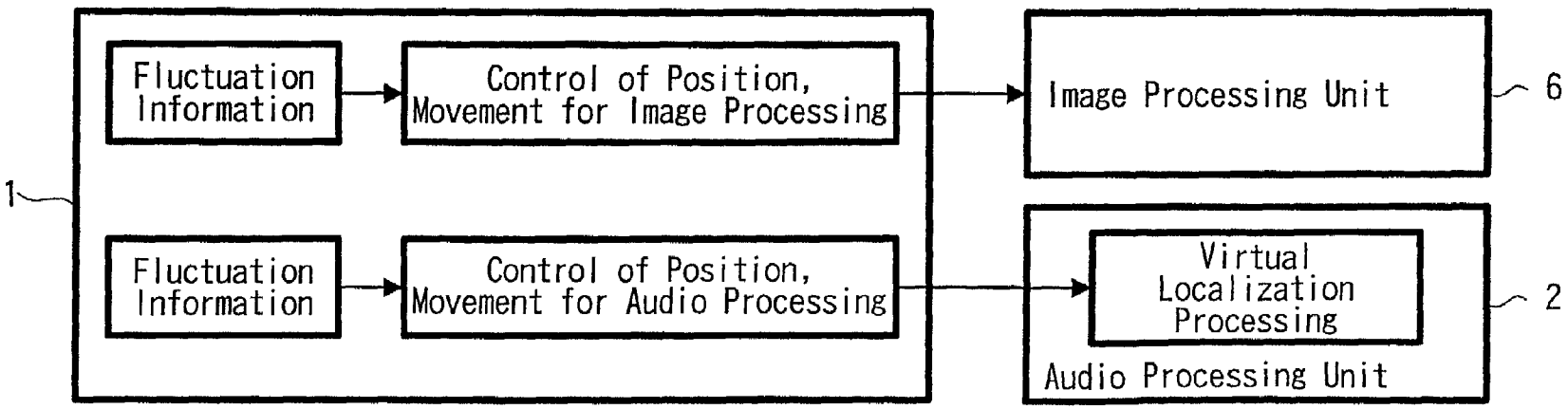
FIG. 3 is a line diagram used in explanation of this invention.

That is, in the game equipment of this example, as shown in FIG. 2 and FIG. 3, the CPU 1 controls the image processing unit 6 and audio processing unit 2 respectively without necessarily taking into consideration the synchronization between the image processing position and movement control, and the audio processing position and movement control. In FIG. 3, fluctuation information is added to the configuration of FIG. 2.

In FIG. 1, during the initial time unit $T_0$, there are changes (1) in the position and movement information, and in the CPU 1, one information change is created at the end of this time unit $T_0$ as a result of these position and movement information changes (1); this information change is sent to the audio processing unit 2, and in this audio processing unit 2 virtual acoustic image localization processing is performed, and audio processing internal coefficients are changed, based on this information change. In this case, there is only a single change in position and movement information during the time unit $T_0$, and so this position and movement information may be sent as the information change without further modification, or, for example, a single information change may be created by referring to the preceding information change as well.

In the next time unit $T_0$, there are three changes, (2), (3), (4) in the position and movement information, and from these three changes (2), (3), (4) in position and movement information, the CPU 1 creates a single information change when the time unit $T_0$ ends, and sends this one information change to the audio processing unit 2. At the audio processing unit 2, virtual acoustic image localization processing is performed based on this information change, and audio processing internal coefficients are changed.

In this case, when there are a plurality of changes, for example three, in the position and movement information during the time unit $T_0$, the CPU 1 may for example either take the average of the three and uses this average value as the information change, or may use the last position or movement information change (4) as the information change, or may use the first position and movement information change (2) as the information change. For example, in a case in which a sound source is positioned in the forward direction, and instructions are given to move one inch to the right in succession by means of position changes (2), (3), (4), the final position information (4) may be creased as the information change. Or, in a case in which (2) and (3) are similar, but in (4) the instruction causes movement by one inch to the left (returning), the first position information (2) may be used, or the final position information (4) may be used, or the average of these changes may be taken. Further, when there are a plurality of movement information, these may be added as vectors to obtain a single movement information element, or either interpolation or extrapolation, or some other method, may be used to infer an information change based on a plurality of position or movement information elements.

During the third time unit $T_0$, there is no change in sound source position or movement information. At this time, the CPU 1 either transmits to the audio processing unit the same information change, for example, as that applied in the immediately preceding time unit, or does not transmit any information change.

Subsequent operation is an ordered repetition of what has been described above.

Because this change in sound source position and movement information is generally computed digitally by the CPU 1 or similar, it takes on discrete values. The changes in position and movement information in this example do not necessarily represent changes in the smallest units of discrete position and movement values. By determining in advance appropriate threshold values for the minimum units of changes in position and movement information exchanged between the CPU 1 and audio processing unit 2, according to the control and audio processing methods used, human perceptual resolution and other parameters, when these thresholds are exceeded, changes in the position or movement information are regarded as having occurred. However, it is conceivable that a series of changes smaller than this threshold may occur; hence changes may be accumulated (integrated) over the prescribed time length, and when the accumulated value exceeds the threshold value, position or movement information may be changed, and the information change transmitted.

This example is configured as described above, so that even when there are frequent changes in position or movement information, a single information change is created in the prescribed time unit $T_0$, and by means of this information change, the processing of the audio processing unit 2 is performed. Hence the virtual acoustic image localization processing and internal processing coefficient modification of this audio processing unit 2 are completed within each time unit $T_0$, and processing by the audio processing unit 2 is reduced compared with conventional equipment.

In the above example, it was stated that virtual acoustic image localization processing due to changes in sound source position and movement information is performed in accordance with the elapsed time; in place of this, virtual acoustic image localization processing of the sound source signals may be performed in advance based on a plurality of localization positions for the sound source signals, the plurality of synthesized sound source signals obtained by this localization processing may be stored in memory (storage means) 3, and when a plurality of changes in any one of the position information, movement information, or localization information are applied within the prescribed time unit $T_0$, a single information change may be created based on this plurality of information changes, and synthesized sound source signals read and reproduced from the memory 3 based on this generated information change.

It can be easily seen that in this case also, an advantageous result similar to that of the above example is obtained.

In the above example, it was stated that time units are constant; however, time units may be made of variable length as necessary. For example, in a case in which changes in the localization position are rectilinear or otherwise simple, this time unit may be made longer, and processing by the audio processing unit may be reduced. In cases of localization in directions in which human perceptual resolution of sound source directions is high (for example, the forward direction), this time unit may be made shorter, and audio processing performed in greater detail; conversely, when localizing in directions in which perceptual resolution is relatively low, this time unit may be made longer, and representative information changes may be generated for the changes in localization position within this time unit, to perform approximate acoustic image localization processing.

This invention is not limited to the above example, and of course various other configurations may be employed, so essence of this invention is preserved.

By means of this invention, even when there are frequent changes in position or movement information, one information change is created in a prescribed time unit $T_0$, and this information change is used to perform the processing of the audio processing unit. Hence the virtual acoustic image localization processing and internal processing coefficient changes of the audio processing unit are completed within each time unit $T_0$, and processing by this audio processing unit is reduced compared with previous equipment.

Having described preferred embodiments of the present invention with reference to the accompanying drawings, it is to be understood that the present invention is not limited to the above-mentioned embodiments and that various changes and modifications can be effected therein by one skilled in the art without departing from the spirit or scope of the present invention as defined in the appended claims.

What is claimed is:

1. An audio signal processing method that performs virtual acoustic image localization processing of digital audio signals based on at least one type of information among position change information, movement information, and localization information of an acoustic image, the method comprising the steps of:

when there are a plurality of changes in said information within a prescribed period of time and when an accumulated value of the plurality of changes exceeds a threshold value, generating single modified information of at least one of position and movement at the end of said prescribed period of time based on said plurality of changes in said information; and performing virtual acoustic image localization processing for said digital audio signals based on said generated single modified information, wherein said prescribed period of time is an integral multiple of the sampling period of said digital audio signals.

2. The audio signal processing method according to claim 1, wherein the step of generating said single modified information is performed using only said information presented last within said prescribed period of time.

3. The audio signal processing method according to claim 1, wherein said information for said digital audio signals can be modified according to user operations.

4. An audio signal processing method that performs virtual acoustic image localization processing for digital audio signals having at least one type of information among position change information, movement information and localization information of an acoustic image, based on said information, the method comprising the steps of:

when a plurality of said information elements are contained within a prescribed period of time and when an accumulated value of the plurality of said information elements exceeds a threshold value, generating single modified information of at least one of position and movement at the end of said prescribed period of time based on said plurality of said information elements; and performing virtual acoustic image localization processing for said digital audio signals based on said generated single modified information, wherein said prescribed period of time is an integral multiple of the sampling period of said digital audio signals.

5. The audio signal processing method according to claim 4, wherein said step of generating a single information change is performed using only a last one of said plurality of said information elements presented within said prescribed period of time.

6. The audio signal processing method according to claim 4, wherein said information possessed by said audio signals can be modified according to user operations.

7. An audio signal processing method in which, when a plurality of information changes of at least one information type among position change information, movement information, and localization information of an acoustic image are applied to digital audio signals within a prescribed period of time, the method comprising the steps of:

generating single modified information of at least one of position and movement at the end of said prescribed period of time based on said plurality of information changes when an accumulated value of the plurality of information changes exceeds a threshold value;

performing virtual acoustic image localization processing in advance on said audio signals based on a plurality of localization positions of the digital audio signals and producing a plurality of synthesized audio signals;

and based on the generated single modified information, reading out from storage means, in which are stored the plurality of synthesized audio signals obtained from the localization processing, at least one of said synthesized audio signals, wherein said prescribed period of time is an integral multiple of the sampling period of said digital audio signals.

8. The audio signal processing method according to claim 7, wherein said step of generating a single modified information is performed using only a last one of said information elements presented within said prescribed period of time.

9. The audio signal processing method according to claim 7, wherein said information possessed by said digital audio signals can be modified according to user operations.

10. An audio apparatus, comprising an audio signal processing unit for performing virtual acoustic image localization processing of digital audio signals based on at least one information type among position change information, movement information, and localization information of an acoustic image thereon; and information change generation means for generating, when a plurality of changes are made to said information within a prescribed time period and when an accumulated value of the plurality of changes exceeds a threshold value, single modified information of at least one of position and movement within said prescribed time period based on said plurality of information changes, wherein said audio processing unit is controlled, based on the single modified information generated by said information change generation means, to perform virtual acoustic image localization processing of said digital audio signals, wherein said prescribed period of time is an integral multiple of the sampling period of said digital audio signals.

11. An audio signal processing apparatus, comprising:

an audio processing unit for performing virtual acoustic image localization processing of digital audio signals, having at least one type of information among position change information, movement information, and localization information of an acoustic image, associated with time information and/or event information, based on said information; and information change generation means for generating, when there are a plurality of said information changes within a prescribed time period and when an accumulated value of the plurality of said information changes exceeds a threshold value, single modified information of at least one of position and movement at the end of said prescribed time period based on said plurality of information changes, wherein said audio processing unit is controlled, based on the single modified information generated by said information change generation means, to perform virtual acoustic image localization processing of said digital audio signals, wherein said prescribed period of time is an integral multiple of the sampling period of said digital audio signals.

12. An audio signal processing apparatus, comprising:

an information change generation means for generating, when a plurality of changes in at least one type of information for digital audio signals among position change information, movement information, and localization information of an acoustic image are requested within a prescribed time period and when an accumulated value of the plurality of changes exceeds a threshold value, single modified information at the end of said prescribed time period based on said plurality of information of at least one of position and movement changes; and storage means for storing a plurality of synthesized audio signals obtained from the localization processing, wherein virtual acoustic image localization processing is performed in advance on said digital audio signals based on a plurality of localization positions of the digital audio signals, and based on said single modified information generated by said information change generation means, from said storage means in which are stored the plurality of synthesized audio signals obtained from this localization, wherein said prescribed period of time is an integral multiple of the sampling period of said digital audio signals.

* * * * *